US012408761B2

(12) United States Patent
Shan et al.

(10) Patent No.: US 12,408,761 B2
(45) Date of Patent: Sep. 9, 2025

(54) BED BODY STRUCTURE

(71) Applicant: Keeson Technology Corporation Limited, Zhejiang (CN)

(72) Inventors: Huafeng Shan, Zhejiang (CN); Chuanxiang Ji, Zhejiang (CN); Xiang Nie, Zhejiang (CN); Jian Wang, Zhejiang (CN); Hewen Wu, Zhejiang (CN)

(73) Assignee: Keeson Technology Corporation Limited, Jiaxing (CN)

( * ) Notice: Subject to any disclaimer, the term of this patent is extended or adjusted under 35 U.S.C. 154(b) by 831 days.

(21) Appl. No.: 17/628,216

(22) PCT Filed: Aug. 16, 2019

(86) PCT No.: PCT/CN2019/100915
§ 371 (c)(1),
(2) Date: Jan. 18, 2022

(87) PCT Pub. No.: WO2021/017039
PCT Pub. Date: Feb. 4, 2021

(65) Prior Publication Data

US 2022/0248861 A1 Aug. 11, 2022

(30) Foreign Application Priority Data

Jul. 26, 2019 (CN) ..... 201910684803.6

(51) Int. Cl.
*A47C 19/02* (2006.01)

(52) U.S. Cl.
CPC ..... *A47C 19/02* (2013.01)

(58) Field of Classification Search
CPC ..... A47C 19/02; A47C 19/122; A47C 31/023; A47C 20/041; A47C 19/025; A47C 20/04
(Continued)

(56) References Cited

U.S. PATENT DOCUMENTS 3,634,894 A * 1/1972 Harbison ..... A47D 7/03 297/DIG. 2
3,942,626 A * 3/1976 Wilding ..... B65G 39/125 198/826

(Continued)

FOREIGN PATENT DOCUMENTS

CN 201879221 U 6/2011
CN 206729623 U 12/2017
CN 108720413 A 11/2018

OTHER PUBLICATIONS

International Search Report of PCT Patent Application No. PCT/CN2019/100915 issued on Apr. 26, 2020.

*Primary Examiner* — Justin C Mikowski
*Assistant Examiner* — Luke Hall

(57) ABSTRACT

A bed body structure is disclosed which includes a bearing mechanism, a turnover mechanism, a base and a flexible supporting layer; wherein the turnover mechanism is arranged between the bearing mechanism and the base, and the flexible supporting layer covers the top of the bearing mechanism; the bearing mechanism includes at least two supporting assemblies; in a flat-laid state, all the supporting assemblies are horizontally arrayed on the top of the base in sequence; and in an unfolded state, the turnover mechanism enables at least one of the supporting assemblies to be upwards turned over relative to the base.

11 Claims, 5 Drawing Sheets

(58) Field of Classification Search
USPC ..... 5/657
See application file for complete search history.

(56) References Cited

U.S. PATENT DOCUMENTS 4,032,186 A * 6/1977 Pickering ..... B60J 7/062 296/100.13
4,051,565 A * 10/1977 Berge ..... A61G 7/1032 5/81.1 R
4,579,383 A * 4/1986 Colby ..... A47C 4/283 297/411.42
4,843,665 A * 7/1989 Cockel ..... A61G 7/0005 5/81.1 R
4,848,843 A * 7/1989 Gibbs ..... A47C 3/00 297/226
5,199,211 A * 4/1993 McKenzie ..... A01K 69/10 414/142.8
5,364,154 A * 11/1994 Kaiser ..... B60P 3/341 296/105
5,762,403 A * 6/1998 Robinson ..... A47C 31/023 297/440.11
6,029,294 A * 2/2000 Saringer ..... A47C 21/006 5/915
6,293,624 B1 * 9/2001 Gaylord ..... A47C 31/023 297/440.1
6,779,849 B1 * 8/2004 Harper ..... A47C 7/282 297/440.11
10,588,420 B1 * 3/2020 Krenik ..... A47C 19/027
2002/0133877 A1 * 9/2002 Kuiper ..... A61G 7/1021 5/81.1 R
2007/0143922 A1 * 6/2007 Ganance ..... A61G 7/0528 5/624
2013/0180046 A1 * 7/2013 Davis, Jr. ..... A61G 7/1026 5/81.1 HS
2013/0269103 A1 * 10/2013 Van Oirschot ..... A61G 7/1011 5/83.1
2014/0306429 A1 * 10/2014 Patterson ..... A61G 7/0528 280/657
2019/0223609 A1 * 7/2019 Sherman ..... A47C 27/14
2019/0335915 A1 * 11/2019 Wang ..... A47C 7/28
2020/0078238 A1 * 3/2020 Huang ..... A61G 7/012

* cited by examiner

BED BODY STRUCTURE

FIELD OF THE INVENTION

The present invention relates to the field of machinery, and more specifically, to a bed body structure.

BACKGROUND OF THE INVENTION

With the development of the times, a household electric bed, as a new product, has been slowly promoted in the market. As a kind of bedroom furniture, people's requirements for the electric bed are getting higher and higher, and the electric bed needs to have an attractive appearance and a soft texture, as well as sufficient load-bearing performance. In order to meet such requirements, the electric bed is usually supported by a metal frame as a base. A plurality of sets of hinge joints and a board set with liftable foot boards are fixedly arranged on the base. After the board set is wrapped, the outermost side of the board set is wrapped with a fabric, and the fabric is fixed to the back sides of boards with gun nails.

The electric bed adopting the boards uses a lot of materials which mainly includes the boards, filling materials, the fabric, etc., and the cost is high. Glue is required for fixing between the filling materials and the boards as well as between the filling materials and a bed cover, and the peripheral edges of the bed cover need to be fixed with the whole circle of gun nails, so that a process is complex and labor and time costs are high.

SUMMARY OF THE INVENTION

The present invention provides a bed body structure to solve the problem of complex process and low efficiency of using a bed board in the prior art.

The present invention provides a bed body structure, including: a bearing mechanism, a turnover mechanism, a base and a flexible supporting layer; the turnover mechanism is arranged between the bearing mechanism and the base, and the flexible supporting layer covers a top of the bearing mechanism; the bearing mechanism includes at least two supporting assemblies; in a flat-laid state, all the supporting assemblies are horizontally arrayed on a top of the base in sequence; and in an unfolded state, the turnover mechanism enables at least one of the supporting assemblies to be upwards turned over relative to the base.

Further, the bearing mechanism further includes flexible coating structures; and the flexible coating structures coat outer walls of the supporting assemblies.

Further, the bearing mechanism further includes clamping grooves and clamping pieces; the clamping grooves are arranged at the bearing mechanism, and the clamping pieces are detachably arranged in the clamping grooves; edges of the flexible supporting layer are connected with the clamping pieces; and the flexible coating structures are provided with notches corresponding to the clamping grooves.

Further, top faces of the flexible coating structures are flush with top faces of the supporting assemblies.

Further, each of the supporting assemblies consists of a plurality of supporting pieces, and the clamping grooves are arranged at the supporting pieces at edges of the bearing mechanism.

Further, openings of the clamping grooves face middles of the supporting assemblies.

Further, the flexible coating structures have outwards-inclining planes gradually inclining towards inner sides from top to bottom and inwards-inclining planes gradually inclining towards inner sides from bottom to top; and the flexible coating structures coat the supporting pieces at the edges of the bearing mechanism.

Further, the bearing mechanism includes a first supporting assembly, a second supporting assembly, a third supporting assembly, a fourth supporting assembly and a fifth supporting assembly; wherein the first supporting assembly and the second supporting assembly are in pivot connection at a junction, and the third supporting assembly, the fourth supporting assembly and the fifth supporting assembly are in pivot connection at junctions; the first supporting assembly includes a first supporting piece, a second supporting piece, a third supporting piece and a fourth supporting piece, the second supporting assembly includes a fifth supporting piece, a sixth supporting piece, a seventh supporting piece and an eighth supporting piece, the third supporting assembly includes a ninth supporting piece, a tenth supporting piece, an eleventh supporting piece and a twelfth supporting piece, the fourth supporting assembly includes a thirteenth supporting piece, fourteenth supporting piece, a fifteenth supporting piece and a sixteenth supporting piece, and the fifth supporting assembly includes a seventeenth supporting piece, an eighteenth supporting piece, a nineteenth supporting piece and a twentieth supporting piece; the first supporting piece and the second supporting piece which are parallel to each other are perpendicular to the third supporting piece and the fourth supporting piece which are parallel to each other, the first supporting piece, the second supporting piece and the third supporting piece are fixedly connected, and the fourth supporting piece is in lap joint with tops of the first supporting piece and the second supporting piece; the fifth supporting piece and the sixth supporting piece which are parallel to each other are perpendicular to the seventh supporting piece and the eighth supporting piece which are parallel to each other, and the seventh supporting piece and the eighth supporting piece are in lap joint with tops of the fifth supporting piece and the sixth supporting piece; the ninth supporting piece and the tenth supporting piece which are parallel to each other are perpendicular to the eleventh supporting piece and the twelfth supporting piece which are parallel to each other, and the eleventh supporting piece and the twelfth supporting piece are in lap joint with tops of the ninth supporting piece and the tenth supporting piece; the thirteenth supporting piece and the fourteenth supporting piece which are parallel to each other are perpendicular to the fifteenth supporting piece and the sixteenth supporting piece which are parallel to each other, and the fifteenth supporting piece and the sixteenth supporting piece are in lap joint with tops of the thirteenth supporting piece and the fourteenth supporting piece; and the seventeenth supporting piece and the eighteenth supporting piece which are parallel to each other are perpendicular to the nineteenth supporting piece and the twentieth supporting piece which are parallel to each other, the seventeenth supporting piece, the eighteenth supporting piece and the twentieth supporting piece are fixedly connected, and the nineteenth supporting piece is in lap joint with tops of the seventeenth supporting piece and the eighteenth supporting piece.

Further, contacting areas where the supporting pieces are in lap joint with each other are one parts of top face areas of the lapped supporting pieces, the other parts of the top face areas of the lapped supporting pieces are coated with the flexible coating structures, and contacting faces of the flexible coating structures are in contact with end faces of the lapped supporting pieces.

Further, the turnover mechanism includes driving devices, turnover rods, sliding rails and pulley assemblies; the driving devices are respectively in pivot connection with the turnover rods and the base, and horizontal directions of thrusts of the driving devices are the same as horizontal directions of turnover of the corresponding supporting assemblies; the turnover rods are perpendicular to the horizontal directions of turnover of the supporting assemblies, and two ends of the turnover rods are respectively provided with the pulley assemblies; the sliding rails are arranged on the bearing mechanism, and horizontal directions of extending of the sliding rails are parallel to the horizontal directions of the thrusts of the driving devices; the pulley assemblies can slide in the sliding rails, and the pulley assemblies include first pulleys, second pulleys and supporting rods; the first pulleys are in pivot connection with one ends of the supporting rods, the second pulleys are in pivot connection with middles of the supporting rods, and the other ends of the supporting rods are in pivot connection with the base; the middles of the supporting rods protrude towards the supporting assemblies at an obtuse angle; when the bearing mechanism is in the flat-laid state, the second pulleys are in contact with the sliding rails and can slide on bottom faces of the sliding rails; in an unfolding process of the bearing mechanism, both the first pulleys and the second pulleys are in contact with the sliding rails and can slide on the bottom faces of the sliding rails; and the turnover rods and the supporting rods are vertically connected, connection points of the turnover rods and the supporting rods are located between pivot connection positions of the supporting rods and the base and the second pulleys.

Further, the base is fixedly provided with load-bearing parts; and when the bearing mechanism is in the flat-laid state, the load-bearing parts are arranged on positions, between the first pulleys and the second pulleys, of the supporting rods below.

Further, lengths and positions of a gravity arm, a first resistance arm and a second resistance arm in a horizontal direction of the turnover mechanism in a flat-laid state are adjusted according to following formulas (1) and (2) to reduce a length of a power arm in a vertical direction of the turnover mechanism in the flat-laid state:

$$F1 = (G \times L3) \div L1; \quad (1)$$

$$L2 > (F1 \times L4) \div F; \quad (2)$$

where L1 represents the first resistance arm, L2 represents the power arm, L3 represents the gravity arm, L4 represents the second resistance arm, G represents loads of the supporting assemblies, F represents the thrusts, and F1 represents resistance; and where the first resistance arm is on the second resistance arm.

Further, widths of the supporting assemblies coated with the flexible coating structures are larger than heights thereof.

Further, the base includes a front frame and a rear frame; wherein the front frame and the rear frame are in pivot connection; and the first supporting assembly and the second supporting assembly can rotate relative to the third supporting assembly, the fourth supporting assembly and the fifth supporting assembly with an axial line between the front frame and the rear frame as a rotation axis.

According to the bed body structure, the production efficiency is improved, the cost of an electric bed is greatly reduced, and meanwhile it is ensured that the product quality is unchanged. At the same time, due to certain tensioning force between the clamping grooves and the flexible supporting layer, the whole shape is fuller and more valuable.

BRIEF DESCRIPTION OF THE DRAWINGS

By reading the detailed description of the non-restrictive embodiments with reference to the drawings below, other features, objectives and advantages of the present invention will be more apparent.

REFERENCE SIGNS OF THE DESCRIPTION

1—bearing mechanism, 2—turnover mechanism, 3—base, 4—flexible supporting layer, 5—supporting assembly, 6—first supporting assembly, 7—second supporting assembly, 8—third supporting assembly, 9—fourth supporting assembly, 10—fifth supporting assembly;

101—flexible coating structure, 102—clamping groove, 103—clamping piece;

1011—outwards-inclining plane, 1012—inwards-inclining plane;

201—driving device, 202—turnover rod, 203—sliding rail, 204—pulley assembly;

2041—first pulley, 2042—second pulley, 2043—supporting rod;

301—load-bearing part, 302—front frame, 303—rear frame;

5001—contacting face, 5002—top face area, 5003—contacting face of flexible coating structure, 5004—end face of supporting piece;

601—first supporting piece, 602—second supporting piece, 603—third supporting piece, 604—fourth supporting piece, 701—fifth supporting piece, 702—sixth supporting piece, 703—seventh supporting piece, 704—eighth supporting piece, 801—ninth supporting piece, 802—tenth supporting piece, 803—eleventh supporting piece, 804—twelfth supporting piece, 901—thirteenth supporting piece, 902—fourteenth supporting piece, 903—fifteenth supporting piece, 904—sixteenth supporting piece, 1001—seventeenth supporting piece, 1002—eighteenth supporting piece,

1003—nineteenth supporting piece, 1004—twentieth supporting piece, 1005—connecting rod.

DETAILED DESCRIPTION OF THE EMBODIMENTS

The present invention will be further described in detail below in conjunction with accompanying drawings.

Figure 1:
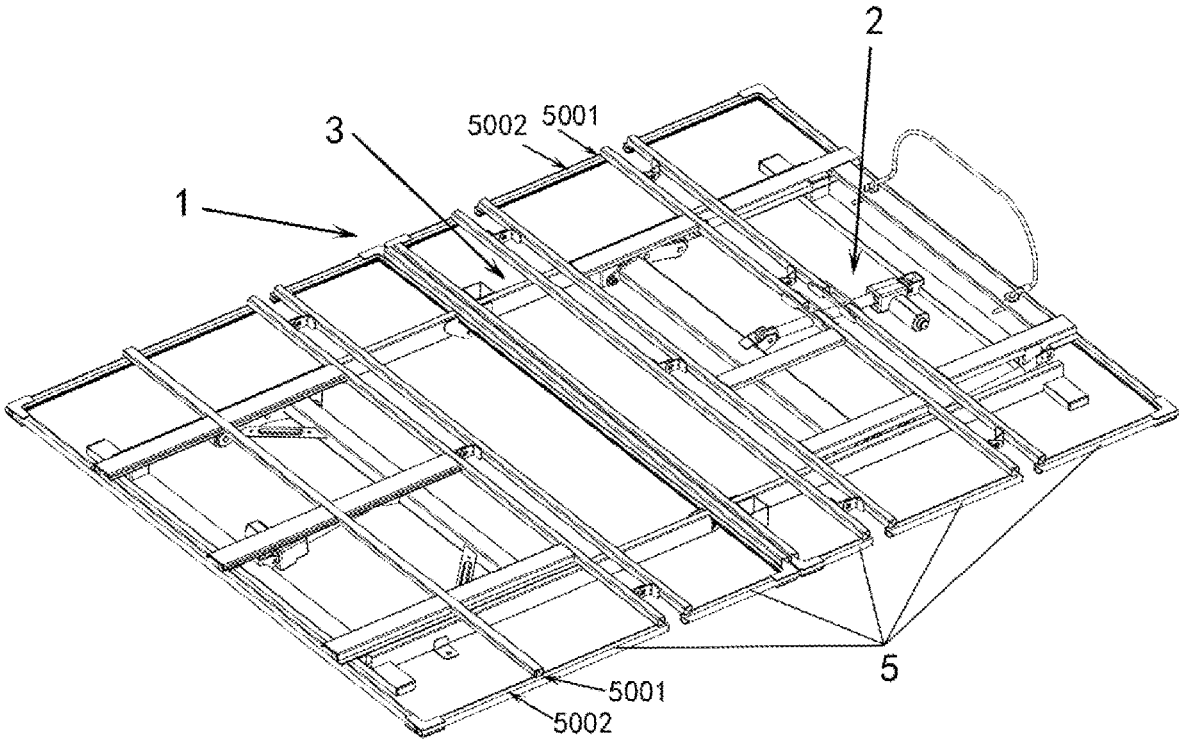
FIG. 1 is a schematic structural diagram of a bed body structure of an embodiment of the present invention (without a flexible supporting layer)
Figure 2:
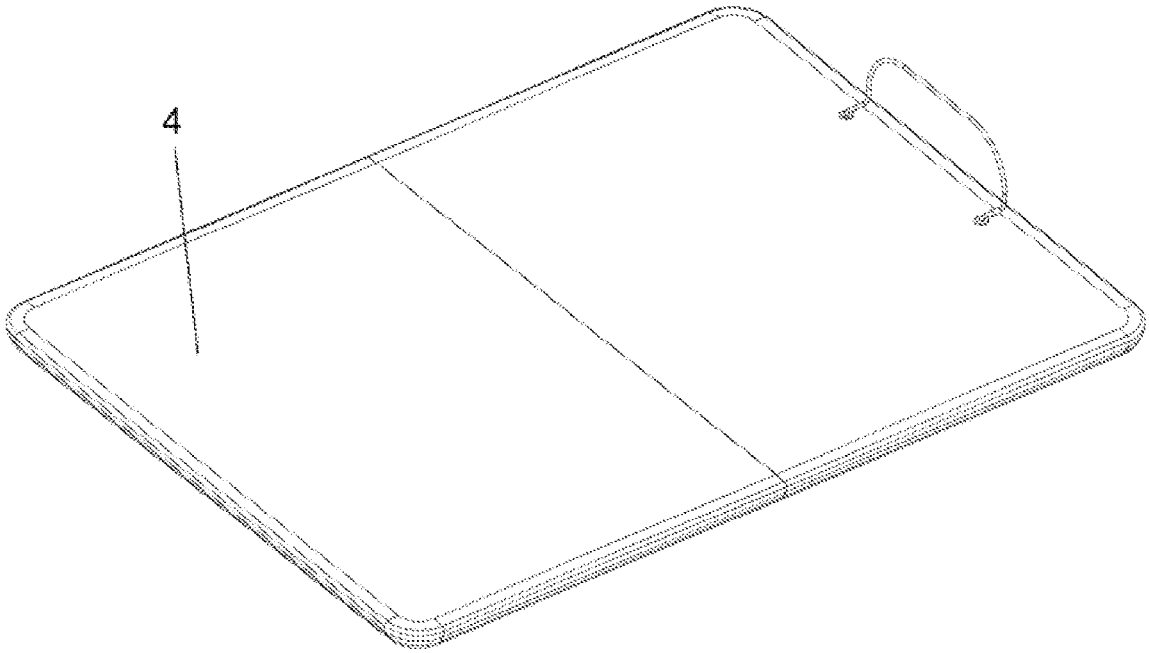
FIG. 2 is a schematic structural diagram of a bed body structure of an embodiment of the present invention (with a flexible supporting layer)

FIG. 1 is a structural diagram of a bed body structure of an embodiment of the present invention (without a flexible supporting layer), and FIG. 2 is a structural diagram of a bed body structure of an embodiment of the present invention (with a flexible supporting layer). As shown in FIG. 1 and FIG. 2, a bed body structure provided by the present invention includes a bearing mechanism 1, a turnover mechanism 2, a base 3 and a flexible supporting layer 4; the turnover mechanism 2 is arranged between the bearing mechanism and the base 3, and the flexible supporting layer 4 covers the top of the bearing mechanism 1; the bearing mechanism 1 includes at least two supporting assemblies 5; in a flat-laid state, all the supporting assemblies 5 are horizontally arrayed on the top of the base 3 in sequence; and in an unfolded state, the turnover mechanism 2 enables at least one of the supporting assemblies 5 to be upwards turned over relative to the base.

The turnover mechanism 2 can be arranged according to the number of the supporting assemblies 5 which are required to be adjusted, generally, the need for deformation of most bearing mechanisms 1 can be met by arranging two to three supporting assemblies 5, and the specific number of the supporting assemblies is set according to the need.

The bearing mechanism 1 and the flexible supporting layer 4 constitute a supporting face to replace a traditional supporting face of boards. The supporting assemblies 5 can be selectively made of a wide variety of materials and shapes of supporting pieces, such as metal tubes. The metal tubes are connected into quadrangles to serve as the supporting assemblies 5, and it is best to use regular quadrangles, so that an inner space is reasonably arranged to control the size of a whole bed. The most important of all is to completely abandon a bed board, and the boards no longer need to be subjected to the working procedures of cutting, drilling, installing, etc., so that intermediate multifarious working procedures are omitted, a lot of time and labor are saved, the production time of the whole bed is shortened by 30% to 40%, and the production efficiency is greatly improved.

Figure 3:
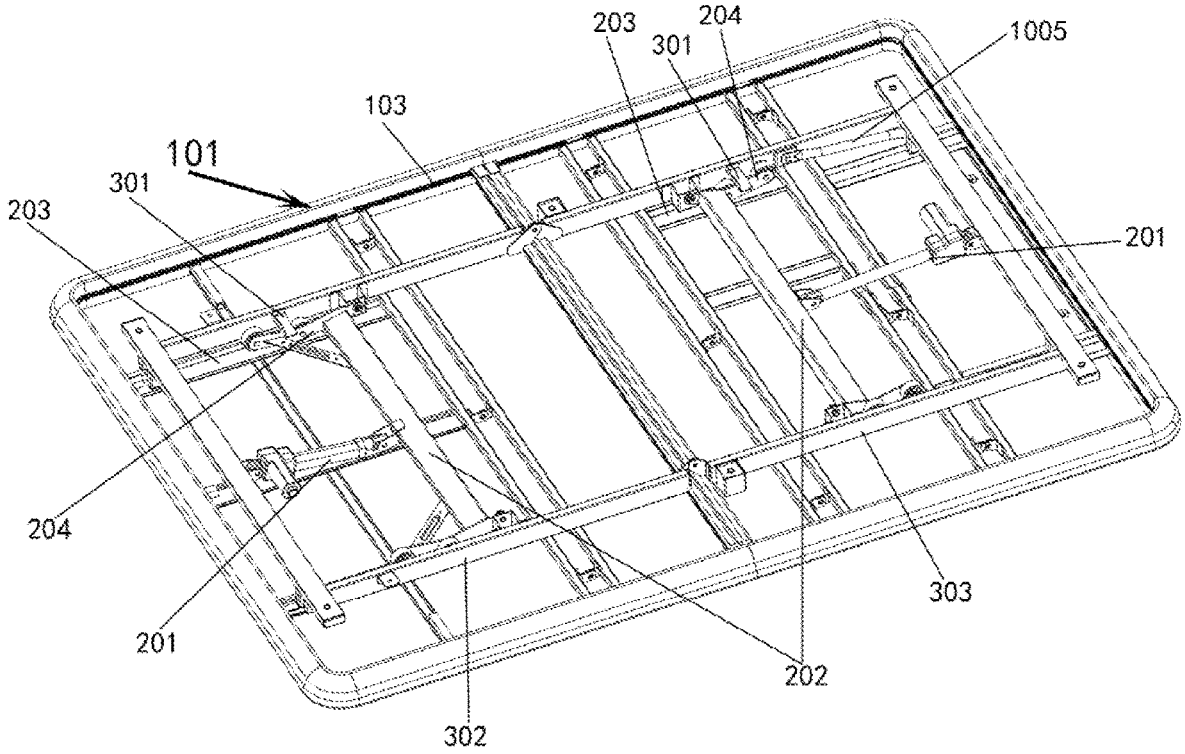
FIG. 3 is a schematic top view of a bed body structure of an embodiment of the present invention.

FIG. 3 is a schematic top view of a bed body structure of an embodiment of the present invention. As illustrated in FIG. 3, the bearing mechanism 1 further includes flexible coating structures 101. The flexible coating structures 101 coat the outer walls of the supporting assemblies 5.

The flexible coating structures 101 wrap the outer side faces of the supporting assemblies 5, and contacting areas between the flexible coating structures 101 and the supporting assemblies 5 are increased so that the flexible coating structures 101 can be more stable. When the bed is used, a mattress is generally placed horizontally on the top face of the bearing mechanism 1. The top face of the bearing mechanism 1 is completely covered with the mattress, but the side edges of the bearing mechanism 1 can still be contacted and observed. It is neither aesthetic nor safe to expose the supporting pieces directly, especially when a user sits by the bed, the user's legs will make contact with the outer side of the bearing mechanism 1, and considering that the bearing mechanism 1 mostly uses metal and various metal fasteners, it may cause damage to a human body when it comes into contact with the human body.

The flexible coating structures 101 can wholly or partially coat the bearing mechanism 1 and can selectively coat only the surfaces of the supporting pieces on the outermost side of the bearing mechanism 1. The flexible coating structures 101 can be made of EPE (expandable polyethylene), ethylene-vinyl acetate copolymer (EVA), sponges or hollow plastic profiles. Inner cavities of the flexible coating structures 101 and the outer walls of the supporting pieces are fitted in shape and form a whole after being fixed with adhesives, which gives the outer side of the bearing mechanism 1 a soft and smooth contour and makes it more attractive, and the damage caused by a direct collision with the bearing mechanism 1 to the user can also be relieved. The situation that a simple appearance cannot fit with functions of a high-end product, thereby leading to the inability of actual sales of a high-end bed without boards is overcome, the actual-sales effect is very good, and the sales volume is increased.

Figure 4:
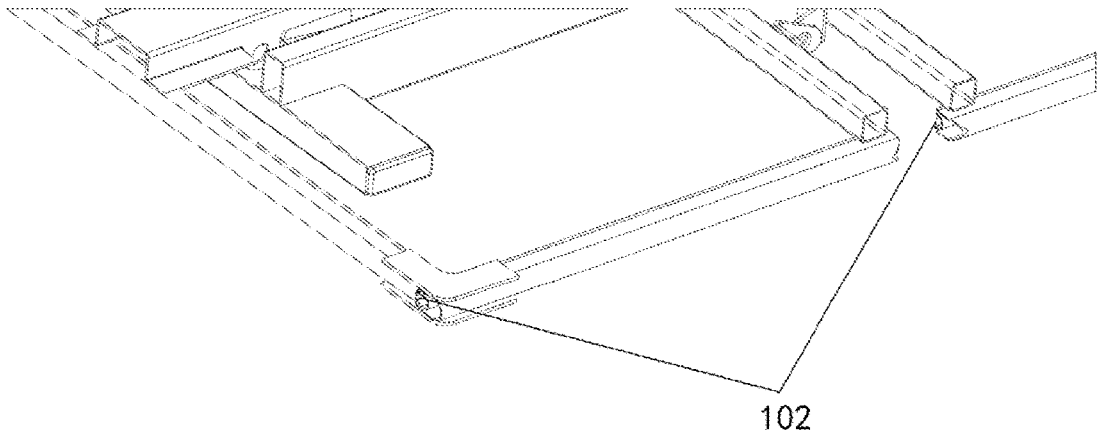
FIG. 4 is a schematic partial enlargement diagram of clamping grooves in an embodiment of the present invention.
Figure 5:
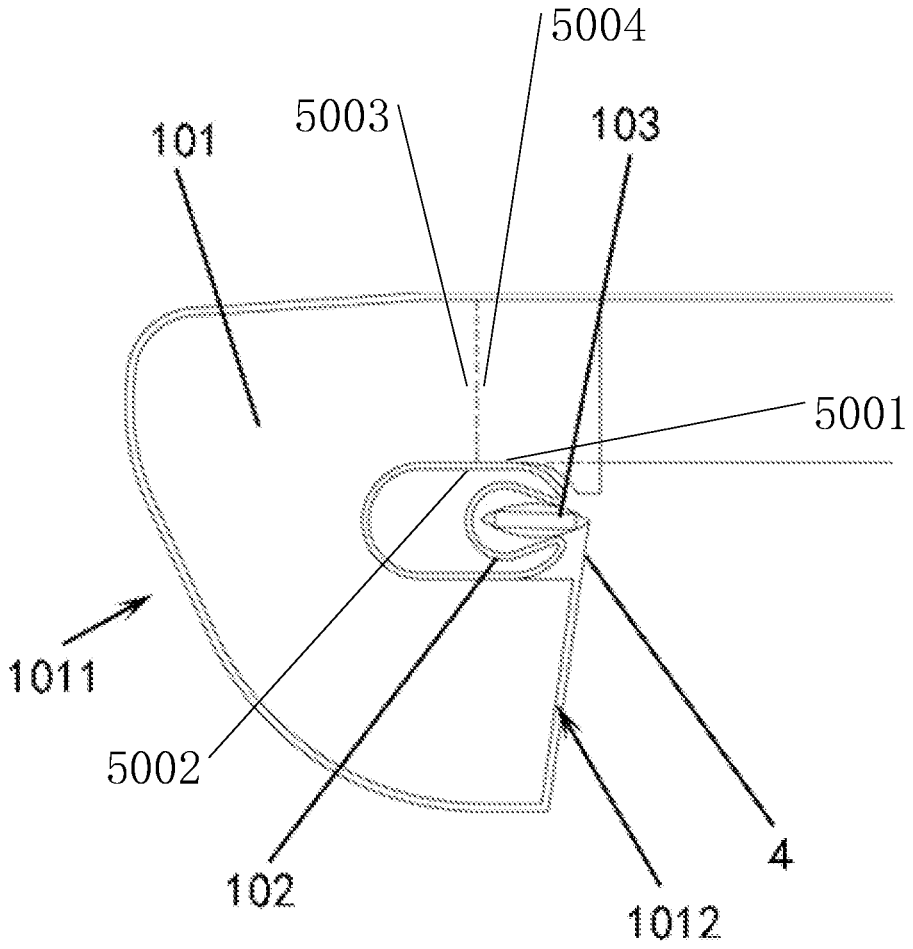
FIG. 5 is a sectional view of supporting pieces coated with flexible coating structures in an embodiment of the present invention.

In addition, by adjusting the sectional shape of the flexible coating structures 101, a variety of shapes can be formed, and the aesthetic and comfort degrees of the product are improved to meet different customer demands. FIG. 2 is a structural diagram of a bed body structure of an embodiment of the present invention (with a flexible supporting layer), FIG. 3 is a schematic top view of a bed body structure of an embodiment of the present invention, FIG. 4 is a partial enlargement diagram of clamping grooves in an embodiment of the present invention and FIG. 5 is a sectional view of supporting pieces coated with flexible coating structures. As shown in FIG. 2 to FIG. 5, the bearing mechanism further includes the clamping grooves 102 and the clamping pieces 103. The clamping grooves 102 are formed in the bearing mechanism 1, and the clamping pieces 103 are detachably arranged in the clamping grooves 102. The edges of the flexible supporting layer 4 are connected with the clamping pieces 103. The flexible coating structures 101 are provided with notches corresponding to the clamping grooves 102.

The flexible supporting layer 4 can selectively made of a non-woven fabric composited with a layer of base fabric, and the base fabric may be materials such as a brushed fabric and a 3D mesh fabric, which increase the supporting strength; the base fabric may be a polyester-cotton fabric and a flame retardant cotton fabric, which increase the strength and plays the role of flame retardant; the non-woven fabric can be added with a waterproof coating or a composite waterproof cloth; and the non-woven fabric can also be composited with sponges, which increase the soft degree. The non-woven fabric can also be replaced with an ultrasonic fabric, or it can be composited with other materials (no non-woven fabric).

Each of the clamping grooves 102 is provided with an opening in the supporting piece which needs to be installed with the corresponding clamping piece 103 and extends towards the inside of the opening to form an open storage space. The clamping pieces 103 are detachably fixed in the clamping grooves 102 to conveniently and rapidly fix the flexible supporting layer 4. Without increasing the size of the bearing mechanism 1, the clamping grooves 102 and the clamping pieces 103 are arranged to tension the flexible supporting layer 4.

The supporting pieces are wrapped with the flexible coating structures 101, and notches corresponding to the clamping grooves 102 in position are reserved in the flexible coating structures 101 so as to install the clamping pieces 103. Then the top face of the bearing mechanism 1 is covered with the flexible supporting layer 4, the edges of the flexible supporting layer 4 drop from the edges of the bearing mechanism 1, the outer sides of the flexible coating structures 101 are wrapped with the flexible supporting layer 4, opening tubes with the clamping grooves 102 can be selectively used as the supporting pieces at the peripheral edges of the bearing mechanism 1. The flexible supporting layer 4 is detachably fixed into the clamping grooves 102 via the clamping pieces 103 and tensioned, so that the flexible supporting layer 4 is flat and free of folds. The clamping pieces 103 cannot slide out from openings of the opening tubes due to pretensioning force of the clamping pieces 103. A production process is simplified, the aesthetic degree of the bed is improved, and the bearing mechanism 1 can also be prevented from directly making contact with the mattress and damaging it. The tensioned flexible supporting layer 4 tightly wraps the flexible coating structures 101, which is both attractive and beneficial to preventing the flexible coating structures 101 from deforming.

Figure 6:
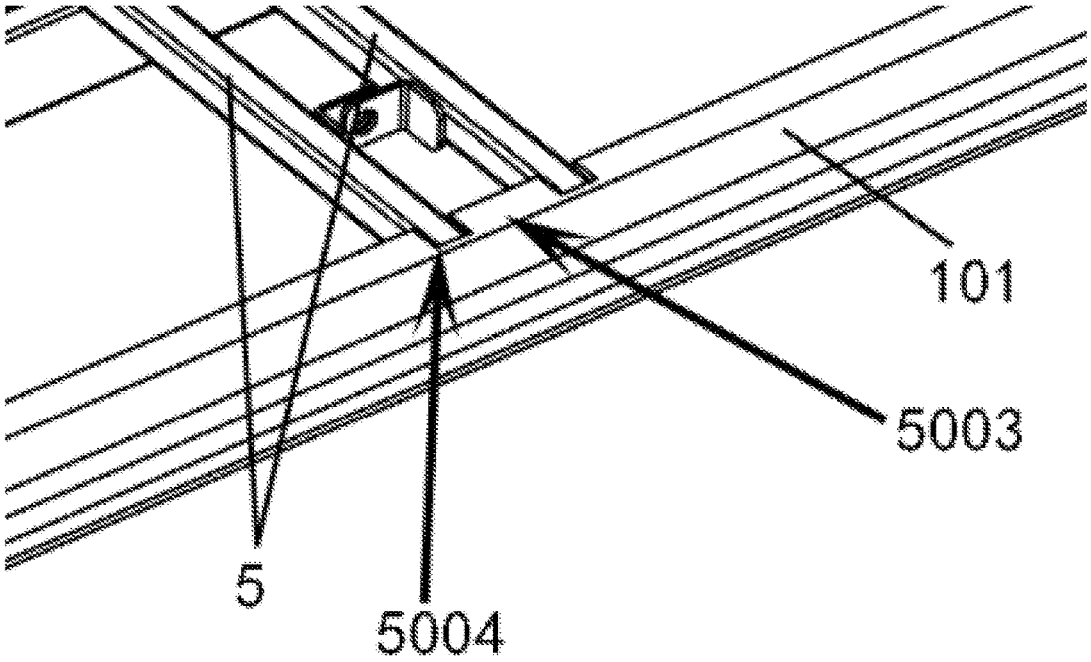
FIG. 6 is a partial enlarged structural diagram of a bed structure of an embodiment of the present invention.

FIG. 1 is a schematic structural diagram of a bed body structure of an embodiment of the present invention (without a flexible supporting layer), and FIG. 6 is a partial enlargement structural diagram of an embodiment of the present invention. As shown in FIG. 1 and FIG. 6, the top faces of the flexible coating structures 101 are flush with the top faces of the supporting assemblies 5.

The top faces of the flexible coating structures 101 are flush with the top faces of the supporting assemblies 5, that is, flush with the top face of the bearing mechanism 1, and at this moment, the mattress is placed on the top face of the bearing mechanism 1 without extruding the flexible coating structures 101. Meanwhile, the flexible coating structures 101 completely shield the side faces of the bearing mechanism 1 and are connected with the lower edges of the mattress into a whole, which provides the user with an attractive appearance and is also beneficial to maintaining the preset shape of the flexible coating structures 101.

Preferably, the top faces of the flexible coating structures 101 are slightly higher than the top faces of the supporting assemblies 5 by about 0.2 cm to 0.5 cm. The flexible coating structures 101 higher than the top faces of the supporting assemblies 5 can serve as buffers for the mattress and a supporting frame. The flexible coating structures 101 made of flexible materials will not deform by a little extrusion, and vibration can also be reduced, giving the user better experience.

Further, each of the supporting assemblies 5 consists of a plurality of supporting pieces, and the clamping grooves 102 are formed in the supporting pieces at the edges of the bearing mechanism 1.

When the flexible supporting layer 4 is installed, the clamping grooves 102 are formed in the supporting pieces at the edges of the bearing mechanism 1, which provides convenience for selecting the large flexible supporting layer 4 to overall shield the top face of the bearing mechanism 1. For example, the flexible supporting layer 4 with the area being larger than the top face of the bearing mechanism 1 is selected, after the flexible supporting layer 4 covers the top face of the bearing mechanism 1, the flexible supporting layer 4 exceeding the top face of the bearing mechanism 1 is clamped into the clamping grooves 102 with the clamping pieces 103, which is both convenient and rapid, and after the whole flexible supporting layer 4 is installed, a good appearance can be provided even without placing the mattress, thereby improving the grade of the product.

Preferably, the clamping grooves 102 are formed in the same horizontal height and form a complete closed circle, which ensures that the flexible supporting layer 4 has uniform tensioning force and is therefore firmer.

FIG. 2 is a schematic structural diagram of a bed body structure of an embodiment of the present invention in bottom view, and FIG. 5 is a sectional view of supporting pieces coated with flexible coating structures. As shown in FIG. 2 and FIG. 5, openings of the clamping grooves 102 face the middles of the supporting assemblies 5.

The openings of the clamping grooves 102 can be in any positions on the outer walls of the supporting pieces, which can meet the need of clamping the flexible supporting layer 4, but it is best to form all the openings of the clamping grooves 102 in the inner sides of the supporting assemblies 5. The flexible supporting layer 4 needs to surround the flexible coating structures 101 by more than half a circle when being installed. The flexible supporting layer 4 wraps the outer sides of the flexible coating structures 101 and is finally fixed into the clamping grooves 102 with the clamping pieces 103. The flexible supporting layer 4 forms a 360-degree wrap that can further fix the flexible coating structures 101 and the whole frame together, so that the flexible coating structures 101 will not shake, which is not only beneficial to maintaining the shape of the flexible coating structures 101, but also beneficial to maintaining tensioning of the flexible supporting layer 4.

FIG. 5 is a sectional view of supporting pieces coated with flexible coating structures. As shown in FIG. 5, the flexible coating structures 101 have outwards-inclining planes 1011 gradually inclining towards the inner sides from top to bottom and inwards-inclining planes 1012 gradually inclining towards the inner sides from bottom to top; and the flexible coating structures 101 coat the supporting pieces at the edges of the bearing mechanism 1.

The flexible supporting layer 4 extends downwards from the openings of the clamping grooves 102 to the bottoms of the flexible coating structures 101, then goes upwards along contours of the flexible coating structures 101 to half-surround the flexible coating structures 101 and then reaches the top face of the bearing mechanism 1. The flexible supporting layer 4 forms the pretensioning force via the design of the inclining planes at one ends of the flexible coating structures 101 to prevent the clamping pieces 103 from being pulled out, and the clamping pieces are clamped in the clamping grooves without being loosened outwards only via an elastic effect.

Figure 7:
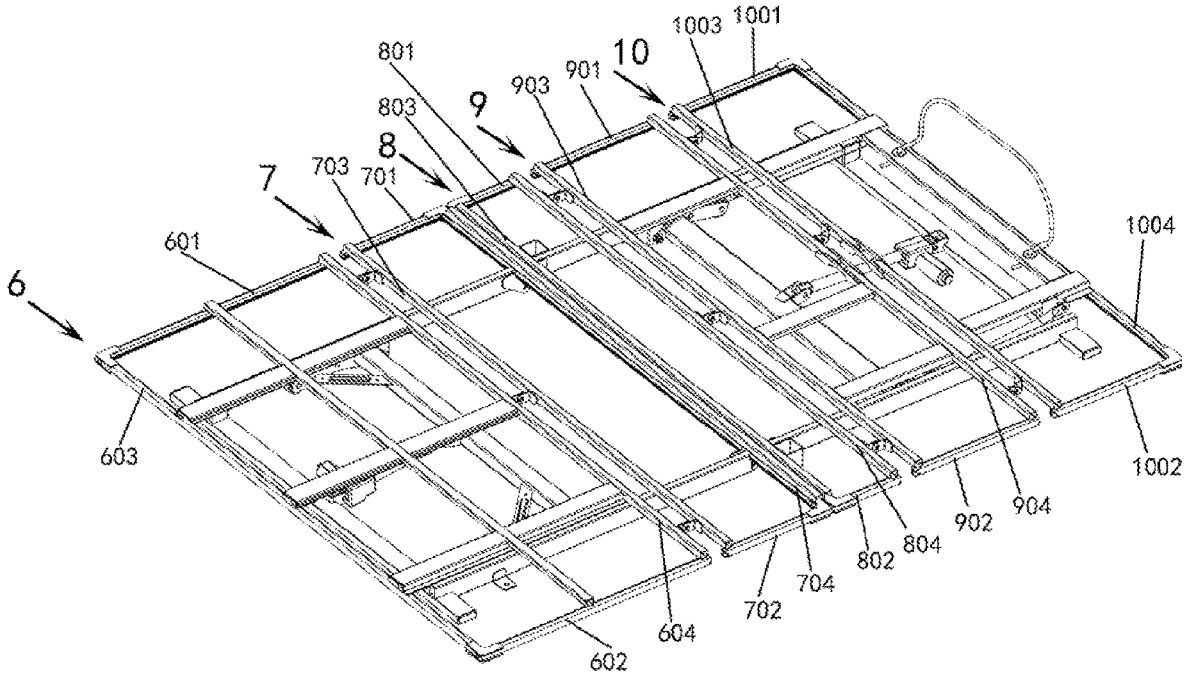
FIG. 7 is a detailed schematic structural diagram of a bed body structure of an embodiment of the present invention.

FIG. 7 is a detailed schematic structural diagram of a bed body structure of an embodiment of the present invention. As shown in FIG. 7, the bearing mechanism 1 includes a first supporting assembly 6, a second supporting assembly 7, a third supporting assembly 8, a fourth supporting assembly 9 and a fifth supporting assembly 10; wherein the first supporting assembly 6 and the second supporting assembly 7 are in pivot connection at a junction, and the third supporting assembly 8, the fourth supporting assembly 9 and the fifth supporting assembly 10 are in pivot connection at junctions; the first supporting assembly 6 includes a first supporting piece 601, a second supporting piece 602, a third supporting piece 603 and a fourth supporting piece 604, the second supporting assembly 7 includes a fifth supporting piece 701, a sixth supporting piece 702, a seventh supporting piece 703 and an eighth supporting piece 704, the third supporting assembly 8 includes a ninth supporting piece 801, a tenth supporting piece 802, an eleventh supporting piece 803 and a twelfth supporting piece 804, the fourth supporting assembly 9 includes a thirteenth supporting piece 901, a fourteenth supporting piece 902, a fifteenth supporting piece 903 and a sixteenth supporting piece 904, and the fifth supporting assembly 10 includes a seventeenth supporting piece 1001, an eighteenth supporting piece 1002, a nineteenth supporting piece 1003 and a twentieth supporting piece 1004; the first supporting piece 601 and the second supporting piece 602 which are parallel to each other are perpendicular to the third supporting piece 603 and the fourth supporting piece 604 which are parallel to each other, the first supporting piece 601, the second supporting piece 602 and the third supporting piece 603 are fixedly connected, and the fourth supporting piece 604 is in lap joint with the tops of the first supporting piece 601 and the second supporting piece 602; the fifth supporting piece 701 and the sixth supporting piece 702 which are parallel to each other are perpendicular to the seventh supporting piece 703 and the eighth supporting piece 704 which are parallel to each other, and the seventh supporting piece 703 and the eighth supporting piece 704 are in lap joint with the tops of the fifth supporting piece 701 and the sixth supporting piece 702; the ninth supporting piece 801 and the tenth supporting piece 802 which are parallel to each other are perpendicular to the eleventh supporting piece 803 and the twelfth supporting piece 804 which are parallel to each other, and the eleventh supporting piece 803 and the twelfth supporting piece 804 are in lap joint with the tops of the ninth supporting piece 801 and the tenth supporting piece 802; the thirteenth supporting piece 901 and the fourteenth supporting piece 902 which are parallel to each other are perpendicular to the fifteenth supporting piece 903 and the sixteenth supporting piece 904 which are parallel to each other, and the fifteenth supporting piece 903 and the sixteenth supporting piece 904 are in lap joint with the tops of the thirteenth supporting piece 901 and the fourteenth supporting piece 902; and the seventeenth supporting piece 1001 and the eighteenth supporting piece 1002 which are parallel to each other are perpendicular to the nineteenth supporting piece 1003 and the twentieth supporting piece 1004 which are parallel to each other, the seventeenth supporting piece 1001, the eighteenth supporting piece 1002 and the twentieth supporting piece 1004 are fixedly connected, and the nineteenth supporting piece 1003 is in lap joint with the tops of the seventeenth supporting piece 1001 and the eighteenth supporting piece 1002.

The supporting pieces are connected with each other to form the rectangular supporting assemblies 5, the plurality of supporting assemblies 5 constitute the bearing mechanism 1, each of the supporting assemblies 5 serves as a supporting face, and the plurality of supporting faces constitute a bed surface for placing the mattress. In daily life, the supporting face of the bed is completely flat. Lapping joint is construction of the height differences between the supporting pieces. The supporting pieces in the supporting assemblies are not at the same plane, which is beneficial to adhering of the flexible coating structures 101 to the supporting pieces at the edges of the bearing mechanism 1 to increase the support for the flexible coating structures 101; and the top faces of the flexible coating structures 101 form the same plane with the top faces of the supporting assemblies 5, that is, form a complete supporting face with the upper surface of the bearing mechanism 1 in the flat-laid state, so that the bearing mechanism 1 can bear more body weight to prevent the flexible coating structures 101 from being flattened and maintain the integrity of the appearance.

In addition, the supporting pieces can further be continuously added on the supporting assemblies to serve as reinforcing rods and equipment installation bases. For example, new supporting pieces are added to the first supporting assembly to provide a better support for the mattress or serve as bases for installing a massager.

FIG. 1 is a schematic structural diagram of a bed body structure of an embodiment of the present invention (without a flexible supporting layer), and FIG. 6 is a partial enlarged structural diagram of an embodiment of the present invention. As shown in FIG. 1, FIG. 5 and FIG. 6, contacting areas 5001 where the supporting pieces are in lap joint with each other are one parts of top face areas 5002 of the lapped supporting pieces, the other parts of the top face areas of the lapped supporting pieces are coated with the flexible coating structures 101, and contacting faces 5003 of the flexible coating structures are in contact with the end faces of the lapped supporting pieces 5004.

For example, the fourth supporting piece 604 is in lap joint with the first supporting piece 601, the contacting area where the supporting piece 604 and the supporting piece 601 are in lap joint with each other is one part of the top face area of the lapped first supporting piece 601, the other part of the top face area of the first supporting piece 601 is coated with the corresponding flexible coating structure 101, and the end faces of the two ends of the lapped fourth supporting piece 604 are both in contact with the contacting faces of the corresponding flexible coating structures; the top face of the fourth supporting piece 604 is flush with the top faces of the flexible coating structures 101 to constitute the seamless flat bed surface; and when the flexible supporting layer covers the bed surface, there will be no other protruding parts on the bed, and the appearance is reflected as a smooth whole.

The notches are formed in the flexible coating structures 101 and exactly wrap the lapped ends to increase longitudinal and transverse supporting forces of the flexible coating structures 101. When the weight of the human body rests on the flexible coating structures 101 at the edges of the bed, the flexible coating structures 101 can be better supported and maintain the shape. Such structures make the edges of a bed body have flexible coat parts that enable the human body to feel pretty comfortable as well as have parts with good rigidity that can effectively bear the weight.

In addition, in the transport process of a container, beds are stacked on top of each other, the bed at the bottom needs to bear a great deal of weight, and thus as for a traditional wooden bed with flexible coats, the flexible coats are often prone to being flattened. While such structural design can effectively solve this problem, and all the weight is borne by an iron stand.

Figure 8:
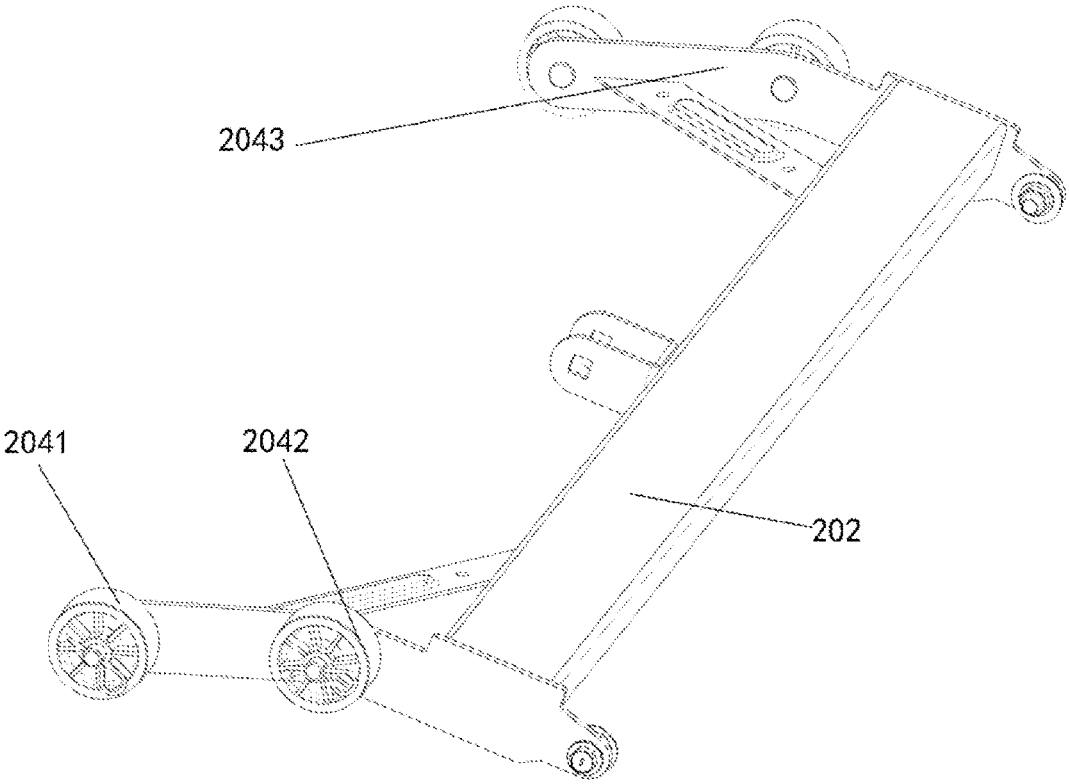
FIG. 8 is a schematic structural diagram of pulley assemblies in an embodiment of the present invention.

FIG. 3 is a schematic top view of a bed body structure of an embodiment of the present invention, and FIG. 8 is a schematic structural diagram of pulley assemblies in an embodiment of the present invention. As shown in FIG. 3 and FIG. 8, the turnover mechanism 2 includes driving devices 201, turnover rods 202, sliding rails 203 and pulley assemblies 204; the driving devices 201 are respectively in pivot connection with the turnover rods 202 and the base 3, and horizontal directions of thrusts of the driving devices 201 are the same as horizontal directions of turnover of the corresponding supporting assemblies 5; the turnover rods 202 are perpendicular to the horizontal directions of turnover of the supporting assemblies 5, and the two ends of the turnover rods 202 are respectively provided with the pulley assemblies 204; the sliding rails 203 are arranged on the bearing mechanism 1, horizontal directions of extending of the sliding rails 203 are parallel to the horizontal directions of the thrusts of the driving devices 201; the pulley assemblies 204 can slide in the sliding rails 203, and the pulley assemblies 204 include first pulleys 2041, second pulleys 2042 and supporting rods 2043; the first pulleys 2041 are in pivot connection with one ends of the supporting rods 2043, the second pulleys 2042 are in pivot connection with the middles of the supporting rods 2043, and the other ends of the supporting rods 2043 are in pivot connection with the base 3; the middles of the supporting rods 2043 protrude towards the supporting assemblies 5 at an obtuse angle; when the bearing mechanism 1 is in the flat-laid state, the second pulleys 2042 are in contact with the sliding rails 203 and can slide on the bottom faces of the sliding rails 203; in an unfolding process of the bearing mechanism 1, both the first pulleys 2041 and the second pulleys 2042 are in contact with the sliding rails 203 and can slide on the bottom faces of the sliding rails 203; and the turnover rods 202 and the supporting rods 2043 are vertically connected, connection points of the turnover rods 202 and the supporting rods 2043 are located between pivot connection positions of the supporting rods 2043 and the base 3 and the second pulleys 2042.

One ends of the paired sliding assemblies are respectively in pivot connection with the base 3. The supporting rods 2043 are of bent structures, that is, the middles of the supporting rods 2043 are at an obtuse angle, and it is better to select the obtuse angle of about 150 degrees. When working, the driving devices 201 drive the turnover rods 202 to rotate with pivot connection positions of the pulley assemblies 204 and the base 3 as rotation axes, the second pulleys 2042 slide on the corresponding sliding rails 203 and push the corresponding supporting assemblies 5. When the supporting assemblies 5 are turned over by 20 degrees to 30 degrees relative to the base 3, the first pulleys 2041 are also in contact with the sliding rails 203 and slide on the bottom faces of the sliding rails 203. In the case of only one kind of pulleys, when the supporting assemblies are turned over by 20 degrees to 30 degrees, a very large resistance is produced, and the addition of the other kind of pulleys can overcome the resistance and ensure stable turnover of the supporting assemblies 5.

When pushed by the turnover mechanism 2, the fourth supporting assembly 9 is upwards turned over with a pivot axis between the third supporting assembly 8 and the fourth supporting assembly 9 as a rotating axis. The rotating direction of turnover is the same as the horizontal direction from the first pulley 2041 to the second pulley 2042. In addition, if the fourth supporting assembly 9 is provided with the fifth supporting assembly 10 in the direction from the second pulley 2042 to the first pulley 2041 and one end of the fifth supporting assembly 10 is in pivot connection with the fourth supporting assembly 9, the pivot connection end of the fifth supporting assembly 10 with the fourth supporting assembly 9 can also be turned over along with the fourth supporting assembly 9 relative to the base 3. At this moment, only one turnover mechanism 2 can prompt two of the bed boards that are in pivot connection to be turned over together and deform; moreover, a connecting rod 1005 can also be additionally arranged at one end of the fifth supporting assembly 10, via pivot connection between the connecting rod 1005 and the base 3, when the fourth supporting assembly 9 is turned over to a certain angle, the other end of the fifth supporting assembly 10 will be turned over by a certain height with the connecting rod 1005 as the rotation radius, the length of the connecting rod 1005 is adjusted according to the specific structure of the bed to give people a more comfortable posture, and if the connecting rod 1005 is too long or too short, the other end of the fifth supporting assembly 10 cannot be flipped up, In this way, turnover mechanisms in the bed body can be reduced without affecting the turnover function of the supporting assemblies, the weight and size of the bed can also be reduced, and the production cost is reduced.

Further, the base is fixedly provided with load-bearing parts 301; and when the bearing mechanism 1 is in the flat-laid state, the load-bearing parts 301 are located on the positions, between the first pulleys 2041 and the second pulleys 2042, under the supporting rods 2043.

When the turnover mechanism 2 cannot be supported by the base 3 and when the bearing mechanism 1 is laid flat, the turnover mechanism 2 exceeds the opposite side of the base 3 in space, the size of the bed is increased. By arranging the load-bearing parts, the turnover mechanism 2 is limited within a space between the bottom face of the base 3 and the bottom face of the bearing mechanism 1, the size is reduced, and both convenient transportation and more attractiveness are achieved.

Figure 9:
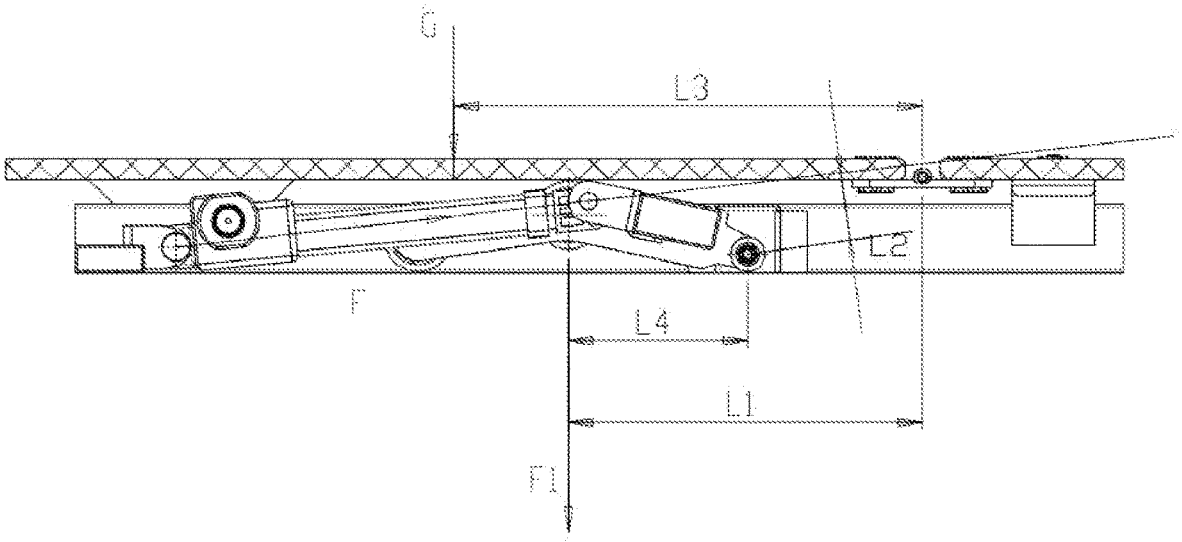
FIG. 9 is a schematic diagram of force arms of a turnover mechanism in an embodiment of the present invention.

FIG. 9 is a schematic diagram of force arms of a turnover mechanism in an embodiment of the present invention. As shown in FIG. 9, lengths and positions of a gravity arm, a first resistance arm and a second resistance arm in a horizontal direction of the turnover mechanism in a flat-laid state are adjusted according to following formulas (1) and (2) to reduce a length of a power arm in a vertical direction of the turnover mechanism in the flat-laid state:

$$F1 = (G \times L3) \div L1; \quad (1)$$

$$L2 > (F1 \times L4) \div F; \quad (2)$$

where L1 represents the first resistance arm, L2 represents the power arm, L3 represents the gravity arm, L4 represents the second resistance arm, G represents loads of the supporting assemblies, F represents the thrusts, and F1 represents resistance; and where the first resistance arm is on the second resistance arm.

Resistance F1 is a force perpendicular to the base 3 from a contact point between the second pulley and the sliding rail, load G is gravity perpendicular to the midpoint of the sliding rail that is in contact with the second pulley, gravity arm L3 is a linear distance from the midpoint of the sliding rail that is in contact with the second pulley to the rotation axis of this supporting assembly, resistance arm L1 is a linear distance from the contact point between the second pulley and the sliding rail to the rotation axis of this supporting assembly, and power arm L2 is a linear distance from a pivot connection point between a supporting rod and the base 3 to an extension line of thrust F.

The length of power arm L2 is directly proportional to the thickness of the turnover mechanism, that is, the shorter power arm L2 is, the thinner the turnover mechanism is, thereby affecting the thickness of the bed body. For example, the length of the first resistance arm is increased and the length of the gravity arm is reduced to reduce the resistance, in the case of reducing the resistance, the length of the second resistance arm is reduced to further reduce the length of the power arm, etc. When F<3000 N and G>1285 N, that is, in the case that the body weight is borne by the bed, through force analysis, the change in positions of the force arms is simulated, the change in force is calculated, the optimal force arm is found, the structure of the force arms of the bed body are optimized, and the thickness of the bed body is reduced, so that the bed body gets thinner.

Further, the widths of the supporting assemblies 5 coated with the flexible coating structures 101 are larger than the heights thereof.

The widths of the supporting pieces are larger than the heights thereof so that higher support performance in the vertical direction can be provided for the flexible coating structures 101.

FIG. 3 is a schematic top view of a bed body structure of an embodiment of the present invention. As shown in FIG. 3, further, the base 3 includes a front frame 302 and a rear frame 303; wherein the front frame 302 and the rear frame 303 are in pivot connection; and the first supporting assembly 6 and the second supporting assembly 7 can rotate relative to the third supporting assembly 8, the fourth supporting assembly 9 and the fifth supporting assembly 10 with an axial line between the front frame 302 and the rear frame 303 as a rotation axis.

The first supporting assembly 6 and the second supporting assembly 7 are arranged on the top of the front frame 302. The third supporting assembly 8, the fourth supporting assembly 9 and the fifth supporting assembly 10 are arranged on the top of the rear frame 303. The edges, closest to a rotation axis between the front frame and the rear frame, of the second supporting assembly 7 and the third supporting assembly 8 can infinitely get close to the rotation axis. The flexible coating structures 101 are also separated at the junction of the front frame 302 and the rear frame 303 to fit with pivot connection between the front frame 302 and the rear frame 303 for folding, and the corresponding supporting assemblies 5 can respectively follow the front frame 302 and the rear frame 303 to be folded. The eighth supporting piece 704 and the eleventh supporting piece 803 respectively extent towards the base 3, clamping grooves 102 are additionally formed in extension sections respectively and form two closed clamping groove 102 circles with other clamping grooves 102, installation is convenient and firm, and flatness of surfaces is ensured, so that the surfaces are visually approximate to a complete plane. At this moment, two flexible supporting layers 4 can be selected to be installed, the two flexible supporting layers 4 are respectively cover the supporting assemblies 5 on the tops of the front frame and the rear frame and then respectively clamped into the clamping grooves 102 with the clamping pieces 103 to be tensioned, which lowers the requirement for the area of a single flexible supporting layer 4 and can also fit with the split-type flexible coating structures 101 and the base 3 for folding, in this way, the bed can be directly constituted in a factory and then transported to a destination in a folded mode, not only is the folding function realized to facilitate transportation and save the cost, but also the integrity of the flexible supporting layer 4 and the aesthetics of the product are ensured.

Preferably, stop rods can further be additionally arranged on the twelfth supporting piece to prevent the mattress from moving in the unfolded state.

After considering the specification and practicing the invention disclosed herein, those skilled in the art will be easily think of other implementations of the present invention. The present application is intended to cover any variations, objectives or adaptive changes of the invention, and these variations, objectives or adaptive changes follow the general principles of the invention and include common general knowledge or conventional means, not disclosed in the present disclosure, in the field. The specification and embodiments are considered exemplary only, and the true scope and spirit of the invention are indicated by the following claims.

It should be appreciated that the present invention is not limited to the precise structure having been described above and shown in the drawings and can make various modifications and changes without departing its scope.

The invention claimed is:

1. A bed body structure, characterized in that the bed body structure includes a bearing mechanism, a turnover mechanism, a base and a flexible supporting layer;

the turnover mechanism is arranged between the bearing mechanism and the base, and the flexible supporting layer covers a top of the bearing mechanism; the bearing mechanism includes at least two supporting assemblies; in a flat-laid state, all the supporting assemblies are horizontally arrayed on a top of the base in sequence; and in an unfolded state, the turnover mechanism enables at least one of the supporting assemblies to be upwards turned over relative to the base;

wherein flexible coating structures have outside planes gradually inclining towards inner sides from top to bottom and inside planes gradually inclining towards inner sides from bottom to top; and flexible coating structures coat the supporting pieces at the edges of the bearing mechanism;

wherein the bearing mechanism includes a first supporting assembly, a second supporting assembly, a third supporting assembly, a fourth supporting assembly and a fifth supporting assembly; wherein the first supporting assembly and the second supporting assembly are in pivot connection at a junction, and the third supporting assembly, the fourth supporting assembly and the fifth supporting assembly are in pivot connection at junctions;

the first supporting assembly includes a first supporting piece, a second supporting piece, a third supporting piece and a fourth supporting piece, the second supporting assembly includes a fifth supporting piece, a sixth supporting piece, a seventh supporting piece and an eighth supporting piece, the third supporting assembly includes a ninth supporting piece, a tenth supporting piece, an eleventh supporting piece and a twelfth supporting piece, the fourth supporting assembly includes a thirteenth supporting piece, a fourteenth supporting piece, a fifteenth supporting piece and a sixteenth supporting piece, and the fifth supporting assembly includes a seventeenth supporting piece, an eighteenth supporting piece, a nineteenth supporting piece and a twentieth supporting piece;

the first supporting piece and the second supporting piece which are parallel to each other are perpendicular to the third supporting piece and the fourth supporting piece which are parallel to each other, the first supporting piece, the second supporting piece and the third supporting piece are fixedly connected, and the fourth supporting piece is in lap joint with tops of the first supporting piece and the second supporting piece;

the fifth supporting piece and the sixth supporting piece which are parallel to each other are perpendicular to the seventh supporting piece and the eighth supporting piece which are parallel to each other, and the seventh supporting piece and the eighth supporting piece are in lap joint with tops of the fifth supporting piece and the sixth supporting piece;

the ninth supporting piece and the tenth supporting piece which are parallel to each other are perpendicular to the eleventh supporting piece and the twelfth supporting piece which are parallel to each other, and the eleventh supporting piece and the twelfth supporting piece are in lap joint with tops of the ninth supporting piece and the tenth supporting piece;

the thirteenth supporting piece and the fourteenth supporting piece which are parallel to each other are perpendicular to the fifteenth supporting piece and the sixteenth supporting piece which are parallel to each other, and the fifteenth supporting piece and the sixteenth supporting piece are in lap joint with tops of the thirteenth supporting piece and the fourteenth supporting piece; and the seventeenth supporting piece and the eighteenth supporting piece which are parallel to each other are perpendicular to the nineteenth supporting piece and the twentieth supporting piece which are parallel to each other, the seventeenth supporting piece, the eighteenth supporting piece and the twentieth supporting piece are fixedly connected, and the nineteenth supporting piece is in lap joint with tops of the seventeenth supporting piece and the eighteenth supporting piece.

2. The bed body structure according to claim 1, wherein the bearing mechanism further includes the flexible coating structures . . . ; and the flexible coating structures coat outer walls of the supporting assemblies.

3. The bed body structure according to claim 2, wherein the bearing mechanism further includes clamping grooves and clamping pieces;

the clamping grooves are arranged at the bearing mechanism, and the clamping pieces are detachably arranged in the clamping grooves; edges of the flexible supporting layer are connected with the clamping pieces; and the flexible coating structures are provided with notches corresponding to the clamping grooves.

4. The bed body structure according to claim 3, wherein top faces of the flexible coating structures are flush with top faces of the supporting assemblies.

5. The bed body structure according to claim 4, wherein each of the supporting assemblies consists of the supporting pieces . . . at the edges of the bearing mechanism.

6. The bed body structure according to claim 5, wherein openings of the clamping grooves face middles of the supporting assemblies.

7. The bed body structure according to claim 1, wherein a lapping supporting piece and a lapped supporting piece form a lap joint, the contacting area of the lapped supporting piece and the lapping supporting piece locates at a first region of the top face area of the lapped supporting piece, a second region of the top face area of the lapped supporting pieces are coated with the flexible coating structures, and the contacting face of the flexible coating structure is in contact with an end face of the lapping supporting pieces.

8. The bed body structure according to claim 7, wherein the turnover mechanism includes driving devices, turnover rods, sliding rails and pulley assemblies; the driving devices are respectively in pivot connection with the turnover rods and the base;

two ends of the turnover rods are respectively provided with the pulley assemblies;

the sliding rails are arranged on the bearing mechanism;

the pulley assemblies can slide in the sliding rails, and the pulley assemblies include first pulleys, second pulleys and supporting rods;

the first pulleys are in pivot connection with one ends of the supporting rods, the second pulleys are in pivot connection with middles of the supporting rods, and the other ends of the supporting rods are in pivot connection with the base;

the middles of the supporting rods protrude towards the supporting assemblies at an obtuse angle;

when the bearing mechanism is in a flat-laid state, the second pulleys are in contact with the sliding rails and can slide on bottom faces of the sliding rails;

in an unfolding process of the bearing mechanism, both the first pulleys and the second pulleys are in contact with the sliding rails and can slide on the bottom faces of the sliding rails; and the turnover rods and the supporting rods are vertically connected, connection points of the turnover rods and the supporting rods are located between pivot connection positions of the supporting rods and the base and the second pulleys.

9. The bed body structure according to claim 8, wherein the base is fixedly provided with load-bearing parts; and when the bearing mechanism is in the flat-laid state, the load-bearing parts are arranged on positions, between the first pulleys and the second pulleys, of the supporting rods below.

10. The bed body structure according to claim 2, wherein widths of the supporting assemblies coated with the flexible coating structures are larger than heights thereof.

11. The bed body structure according to claim 1, wherein the base includes a front frame and a rear frame; wherein the front frame and the rear frame are in pivot connection; and the first supporting assembly and the second supporting assembly can rotate relative to the third supporting assembly, the fourth supporting assembly and the fifth supporting assembly with an axial line between the front frame and the rear frame as a rotation axis.

* * * * *